United States Patent [19]

Kasanami et al.

[11] Patent Number: 4,787,358

[45] Date of Patent: Nov. 29, 1988

[54] FUEL SUPPLY CONTROL SYSTEM FOR AN ENGINE

[75] Inventors: Mitsuru Kasanami; Hideyuki Tamura, both of Kanagawa, Japan

[73] Assignee: Nissan Motor Company, Limited, Kanagawa, Japan

[21] Appl. No.: 929,375

[22] Filed: Nov. 12, 1986

[30] Foreign Application Priority Data

Dec. 23, 1985 [JP] Japan ..... 60-291353

[51] Int. Cl.[4] ..... F02B 3/00

[52] U.S. Cl. ..... 123/492

[58] Field of Search ..... 123/492, 438, 577, 494, 123/422

[56] References Cited

U.S. PATENT DOCUMENTS

| | | | |
|---|---|---|---|
| 3,842,811 | 10/1974 | Shinoda | 123/492 |
| 3,983,850 | 10/1976 | Stumpp | 123/492 |
| 3,983,851 | 10/1976 | Hoshi | 123/492 |
| 4,308,838 | 1/1982 | Nakano | 123/492 |
| 4,312,314 | 1/1982 | McChesney | 123/492 |
| 4,503,829 | 3/1985 | Hasegawa | 123/492 |
| 4,520,783 | 6/1985 | Matsushita | 123/492 |
| 4,527,529 | 7/1985 | Suzuki | 123/492 |

*Primary Examiner*—Raymond A. Nelli

*Attorney, Agent, or Firm*—Foley & Lardner, Schwartz, Jeffery, Schwaab, Mack, Blumenthal & Evans

[57] ABSTRACT

The position of an engine throttle valve is detected. The rate of fuel supply to an engine is increased when the engine moves into a preset condition, e.g., when the engine is required to increase its power output. This increase in the fuel supply rate is enable and disabled in accordance with the detected throttle valve position.

7 Claims, 4 Drawing Sheets

FUEL SUPPLY CONTROL SYSTEM FOR AN ENGINE

BACKGROUND OF THE INVENTION

1. Field of the Invention

This invention relates to a fuel supply control system for an engine, such as an automotive internal combustion engine.

2. Description of the Prior Art

In general spark-ignition engines, the rate of fuel supply in basically controlled in accordance with the rate of air supply in order to maintain the air-to-fuel ratio of an air-fuel mixture at a desired value.

Japanese Patent Publication No. 57-5524 disclosed a fuel supply control system for an internal combustion engine which includes a corrective arrangement operative during engine acceleration. When the engine is required to increase its power output, the corrective arrangement adds a corrective rate of fuel supply to a basic rate of fuel supply so that the engine receives an increased rate of fuel supply relative to the basic rate of fuel supply which depends on the rate of air supply. This increased fuel supply rate improves the engine response characteristics and the engine drivability during engine acceleration.

The fuel supply control system of the above-mentioned Japanese Patent Publication tends to produce an excessively rich air-fuel mixture during engine acceleration at high engine loads.

SUMMARY OF THE INVENTION

It is an object of this invention to provide a fuel supply control system for an engine which prevents an air-fuel mixture from becoming excessively rich when the engine is required to increase its power output at high engine loads.

In accordance with this invention, the rate of fuel supply to an engine is increased when the engine moves into a preset condition. This increase in the fuel supply rate is enabled and disabled in accordance with the position of an engine throttle valve.

DESCRIPTION OF THE PREFERRED EMBODIMENT

Figure 1:
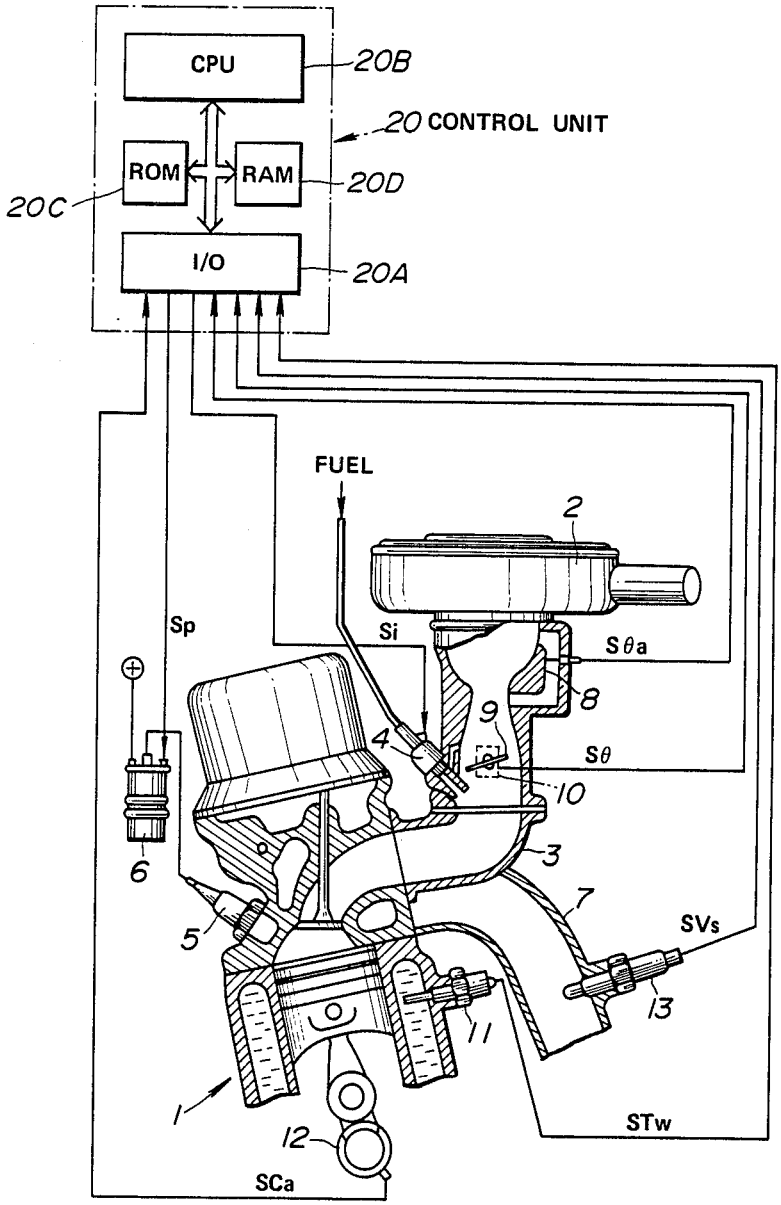
FIG. 1 is a diagram of an internal combustion engine and a fuel supply control system according to an embodiment of this invention.

With reference to FIG. 1, an internal combustion engine 1 has an engine block defining combustion chambers. The engine 1 is provided with an air cleaner 2. An air intake duct 3 extends between the air cleaner 2 and the engine block. Air is drawn into the combustion chambers via the air cleaner 2 and the air intake duct 3.

A downstream segment of the air intake duct 3 is defined by an intake manifold.

An electrically-driven fuel injector 4 injects fuel into the air intake duct 3 at a point upstream of the junction of branches of the intake manifold in accordance with a fuel injection signal Si. The fuel injection signal Si is in the form of a pulse train. While the fuel injector 4 is receiving a fuel injection pulse Si, it remains open and allows fuel to be injected. Accordingly, the quantity of fuel injected during a single injection stroke depends on the pulse width or duration of a fuel injection pulse Si so that the rate of fuel injection depends on the duration of each fuel injection pulse Si. The frequency of the fuel injection pulses Si is proportional to the rotational speed of the crankshaft of the engine 1 so that the fuel injection pulses Si are synchronous with the crankshaft revolutions. It should be noted that fuel injectors may be used to inject fuel into respective branches of the intake manifold.

Spark plugs 5 extend into the combustion chambers respectively. High tension pulses generated by an ignition coil 6 are applied to the spark plugs 5 sequentially via a distributor (not shown). In the case of a direct ignition system where a plurality of ignition coils are provided for spark plugs, the distributor can be omitted. When the spark plug 5 receives a high tension pulse, it causes a spark in the associated combustion chamber. The ignition coil 6 generates high tension pulses in accordance with an ignition signal Sp. The moment of the generation of a high tension pulse, that is, the moment of the generation of a spark, is adjustable via the ignition signal Sp.

A spark ignites an air-fuel mixture in the combustion chamber, causing a combustion of the air-fuel mixture. The resulting exhaust gas is emitted from the combustion chamber to atmosphere via an exhaust pipe 7.

An air flow meter 8 disposed in the air intake duct 3 generates a signal SQa representing the rate of air flow into the combustion chambers via the air intake duct 3. A rotatable throttle valve 9 disposed in the air intake duct 3 adjustably determines the rate of air flow into the combustion chambers. The throttle valve 9 is linked to an accelerator pedal (not shown) so that the degree of opening through the throttle valve 9 depends on the degree of depression of the accelerator pedal. A position sensor 10 generates a signal $S\theta$ representing the position of the throttle valve 9, that is, the degree of opening through the throttle valve 9.

A temperature sensor 11 generates a signal STw representing the temperature of engine coolant flowing in a water jacket within the engine block.

A crank angle sensor 12 generates a signal SCa represeting the angular position of the crankshaft of the engine 1, that is, representing the crank angle. The crank angle signal SCa is in the form of a pulse train. The frequency of the crank angle pulses SCa is proportional to the rotational speed of the crankshaft, that is, proportional to the engine speed. Accordingly, the engine speed is detected by measuring the frequency of the crank angle pulses SCa.

An oxygen sensor 13 attached to the exhaust pipe 7 has a sensing section disposed within the exhaust pipe 7. The oxygen sensor 13 generaes a signal SVs representing whether an air-fuel mixture which caused the exhaust gas currently exposed to the sensor 13 is richer than or leaner than stoichiometric.

A control unit 20 receives the air flow rate signal SQa, the throttle position signal $S\theta$, the coolant temperature signal STw, the crank angle signal SCa, and the air-to-fuel ratio signal SVs. The control unit 20 generates the fuel injection signal Si and the ignition signal Sp. The control unit 20 adjusts the output signals Si and Sp in accordance with the input signals SQa, Sθ, STw, SCa, and SVs. Specifically, the fuel injection pulses Si are controlled in accordance with the crank angle signal SCa so that they are synchronous with the crankshaft revolutions. The duration of each fuel injection pulse Si which determines the quantity of fuel injected during each fuel injection stroke is controlled in accordance with the engine operating conditions represented by the air flow rate signal SQa, the crank angle signal SCa, the throttle position signal Sθ, the coolant temperature signal STw, and the air-to-fuel ratio signal SVs.

Figure 2:
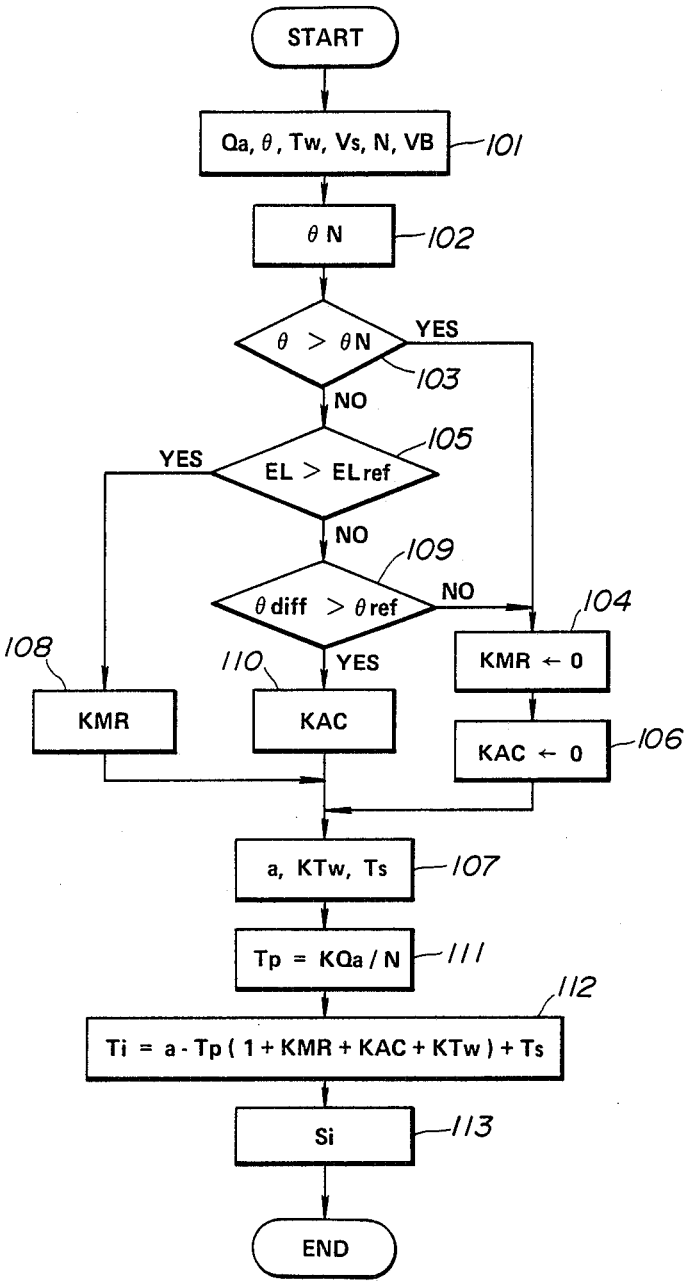
FIG. 2 is a flowchart of a fuel control segment of a program which operates the control unit of FIG. 1.

The control unit 20 includes the combination of an input/output (I/O) circuit 20A, a central processing unit (CPU) 20B, a read-only memory (ROM) 20C, and a random-access memory (RAM) 20D. The control unit 20 operates in accordance with a program stored in the ROM 20C. FIG. 2 is a flowchart of a fuel control segment of the program. The execution of the fuel control segment of the program is reiterated periodically at a preset frequency. It should be noted that the execution of the fuel control segment of the program may be synchronous with the crankshaft revolution.

As shown in FIG. 2, a first step 101 of the fuel control segment of the program derives the current air flow rate Qa, the current degree θ of opening through the throttle valve 9 which will be referred to as the current throttle opening degree θ hereinafter, the current coolant temperature Tw, and the current air-fuel mixture condition value Vs from the signals SQa, Sθ, STw, and SVs. It should be noted that since the air-to-fuel ratio signal SVs represents whether an air-fuel mixture is richer than or leaner than stoichiometric, the mixture condition value Vs assumes either of two different values in accordance with whether the mixture is richer than or leaner than stoichiometric.

The step 101 also derives the current engine speed N from the signal SCa. It should be noted that the I/O circuit 20A of the control unit 20 includes a counter which detects the engine speed by counting the chank angle pulses SCa during a fixed interval of time. Since the engine speed is proportional to the frequency of the crank angle pulses SCa, the engine speed can be detected by counting the crank angle pulses SCa during a fixed interval of time and thereby measuring the frequency of the crank angle pulses SCa. The step 101 derives the current engine speed by referring to the output of the counter in the I/O circuit 20A.

In addition, the step 101 derives the current voltage VB across a DC power source, such as a battery, which drives the fuel injector 4. It should be noted tha the I/O circuit 20A of the control unit 20 is provided with a connection to the DC power source via which the current power source voltage VB is detected and derived.

Figure 3:
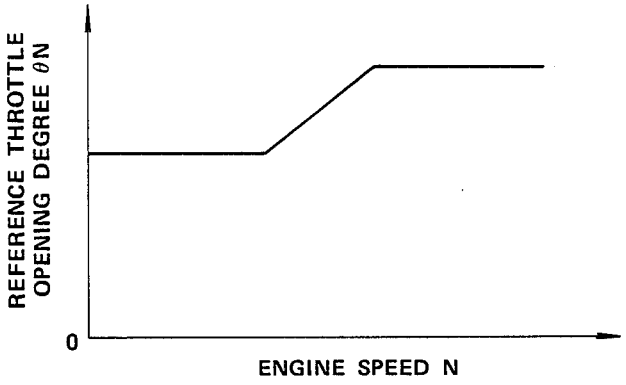
FIG. 3 is a graph of the relationship between the reference throttle opening degree and the engine speed used in the program of FIG. 2.

A step 102 following the step 101 determines a reference throttle opening degree θN in accordance with the engine speed N. The ROM 20C of the control unit 20 holds a table in which a set of reference throttle opening degrees are plotted as a function of engine speed as indicated in FIG. 3. The reference throttle opening degree θN is derived by referring to this table. It should be noted that the reference throttle opening degree θN may be a constant value independent of the engine speed.

A step 103 following the step 102 compares the throttle opening degree θ to the reference throttle opening degree θN. When the throttle opening degree θ is greater than the reference throttle opening degree θN, that is, when the throttle valve 9 is open at a degree higher than a reference degree, the program advances to a step 104. When the throttle opening degree θ is equal to or less than the reference throttle opening degree θN, that is, when the throttle valve 9 is open at a degree equal to or less than a reference degree, the program advances to a step 105.

The step 104 sets a corrective factor KMR to zero. In other words, the corrective factor KMR is set null. After the step 104, the program advances to a step 106.

The step 106 sets a corrective factor KAC to zero. In other words, the corrective factor KAC is set null. After the step 106, the program advances to a step 107.

The step 105 derives the current engine load EL from the air flow rate Qa or both the air flow rate Qa and the engine speed N. It should be noted that the current engine load EL may be derived from a basic desired fuel injection quantity Tp or from both the engine speed N and the basic desired fuel injection quantity Tp which will be described hereinafter. The step 105 compares the engine load EL to a reference engine load ELref to detect whether or not the engine load EL is in a high value range. When the engine load EL exceeds the reference engine load ELref, that is, when the engine load EL resides in the high value range, the program advances to a step 108. When the engine load EL is equal to or less than the reference engine load ELref, that is, when the engine load EL resides outside the high value range, the program advances to a step 109.

The step 108 determines the corrective factor KMR in accordance with the engine load EL. The ROM 20C of the control unit 20 holds a table in which a set of non-zero corrective factors KMR are plotted as a function of engine load. Specifically, the corrective factor KMR increases with the engine load. The corrective factor KMR is derived by referring to this table. After the step 108, the program advances to the step 107.

The step 109 calculates the difference θdiff between the current throttle opening degree and the preceding throttle opening degree by referring to the following equation.

$$\theta diff = \theta(current) - \theta(preceding)$$

where θ(current) represents the throttle opening degree derived in the current execution cycle of the program, and θ(preceding) represents the throttle opening degree derived in the previous execution cycle of the program.

In addition, the step 109 compares the difference θdiff to a reference value θref to detect whether or not the engine 1 is required to increase its power output, that is, whether or not the engine 1 is being accelerated. The reference value θref is zero or positive. When the difference θdiff is larger than the reference value θref, that is, when the engine 1 is required to increase its power output, the program advances to a step 110. When the difference θdiff is equal to or less than the reference value θref, that is, when the engine 1 is not required to increase its power output, the program advances to the step 104 in which the corrective factor KMR is set to zero. The program moves from the step 104 to the step 107 by way of the step 106 in which the corrective factor KAC is set to zero.

It should be noted that the I/O circuit 20A of the control unit 20 may include a device which differentiates the throttle position signal S$\theta$The output of this differentiating device may be used in detecting whether or not the engine 1 is required to increase its power output.

The step 110 determines the corrective factor KAC in accordance with the difference $\theta$diff. The ROM 20C of the control unit 20 holds a table in which a set of non-zero corrective factors KAC are plotted as a function of difference $\theta$diff. Specifically, the corrective factor KAC increases with the difference $\theta$diff. The corrective factor KAC is derived by referring to this table. After the step 110, the program advances to the step 107.

The step 107 determines a corrective factor a in accordance with the mixture condition value Vs. In addition, the step 107 determines a corrective factor Ts in accordance with the power source voltage VB by referring to a preset equation or by referring to a preset function table in the ROM of 20C of the control unit 20. Furthermore, the step 107 determines a corrective factor KTw in accordance with the engine coolant temperature Tw by referring to a preset equation or by referring to a preset function table in the ROM 20C of the control unit 20.

A step 111 subsequent to the step 107 calculates or determines a basic desired fuel injection quantity Tp during a coming fuel injection stroke in accordance with the air flow rate Qa and the engine speed N by referring to the following equation.

$$Tp = K\ Qa/N$$

where K is a preset constant.

A step 112 subsequent to the step 111 calculates or determines a final desired fuel injection quantity Ti during a coming fuel injection stroke in accordance with the basic desired fuel injection quantity Tp and the corrective factors KMR, KAC, KTw, a, and Ts by referring to the following equation.

$$Ti = a\ Tp(1 + KMR + KAC + KTw) + Ts$$

A step 113 following the step 112 controls the fuel injection signal Si in accordance with the final desired fuel injection quantity Ti. Specifically, the duration or pulse width of a fuel injection pulse Si is adjusted in accordance with the final desired fuel injection quanitity Ti so that the actual fuel injection quantity will be equal to the final desired fuel injection quantity. After the step 113, the fuel control segment of the program ends.

In the case where the throttle opening degree $\theta$ is equal to or less than the reference degree $\theta$N, when the engine load is high or when the engine 1 is required to increase its power output, one of the corrective values KMR and KAC is set to non-zero so that the actual fuel injection quantity during a fuel injection stroke is increased by an amount corresponding to the corrective value KMR or KAC. This increased fuel injection quantity improves the engine response characteristics and the engine drivability during engine acceleration or high load engine operation.

In the case where the throttle opening degree $\theta$ exceeds the reference degree $\theta$N, even when the engine load is high or even when the engine 1 is required to increase its power output, the corrective values KMR and KAC are set to zero so that the corrective increase of the actual fuel injection quantity are disabled or prevented. This disablement of the corrective increase of the actual fuel injection quantity prevents an air-fuel mixture from becoming excessively rich during engine acceleration or high load engine operation.

Figure 4:
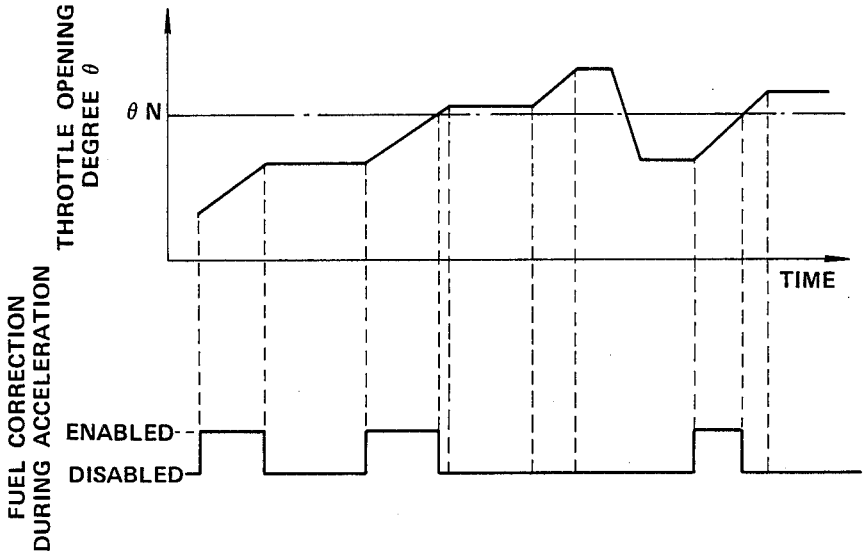
FIG. 4 is a timing diagram of the throttle opening degree and the fuel correction performed by the system of FIG. 1.

It is assumed that the throttle opening degree $\theta$ varies as shown in FIG. 4. In the case where the throttle opening degree $\theta$ is equal to or less than the reference degree $\theta$N, the corrective increase of the actual fuel injection quantity during engine acceleration is enabled as shown in FIG. 4. In the case where the throttle opening degree $\theta$ is greater than the reference degree $\theta$N, the corrective increase of the actual fuel injection quantity during engine acceleration is disabled as shown in FIG. 4.

Figure 5:
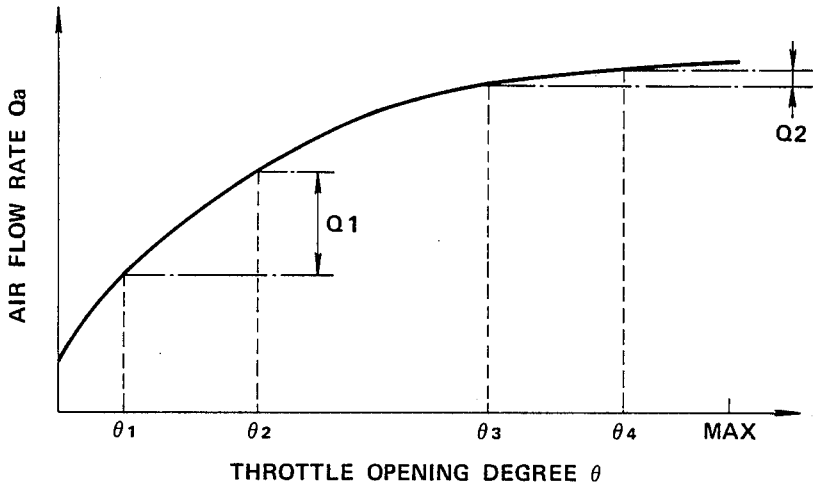
FIG. 5 is a graph of the relationship between the throttle opening degree and the air flow rate in the system of FIG. 1.

FIG. 5 shows the relationship between the throttle opening degree $\theta$ and the air flow rate Qa at a given engine speed. As shown in FIG. 5, as the throttle opening degree $\theta$ increases, the air flow rate Qa increases at a smaller rate. In the range of small and intermediate throttle opening degrees, as the throttle opening degree $\theta$ moves between the points $\theta$1 and $\theta$2, the air flow rate Qa varies by a value Q1. In the range of great throttle opening degrees near the maximal throttle opening degree, as the throttle opening degree $\theta$ moves between the points $\theta$3 and $\theta$4 separated by an interval equal to the difference between the points $\theta$1 and $\theta$2, the air flow rate Qa varies by a value Q2 smaller than the value Q1. Thus, in the range of great throttle opening degrees, a variation in the air flow rate Qa with the throttle opening degree $\theta$ is relatively small. This small variation in the air flow rate would cause an excessively rich air-fuel mixture if a corrective increase of the actual fuel injection quantity was performed during engine acceleration at high engine loads. In the embodiment of this invention, during engine acceleration at high engine loads, the corrective increase of the actual fuel injection quantity is disabled so that an air-fuel mixture is prevented from becoming excessively rich.

What is claimed is:

1. A fuel supply control system including means for supplying a controlled amount of fuel to an internal combustion engine having a throttle valve movable for controlling air flow to the engine, comprising:

sensor means for detecting engine operating conditions including engine load and engine speed;

a throttle sensor for detecting the degree of opening of the throttle valve; and a control unit for controlling the amount of fuel to the engine in accordance with the detected engine operating conditions, the control unit including first enrichment means responsive to a demand for engine acceleration for increasing the amount of fuel to the engine, and means for preventing the first enrichment means from increasing the amount of fuel to the engine when the detected throttle valve opening position is at a degree greater than a reference value, the control unit including second enrichment means for increasing the amount of fuel to the engine when the detected engine load is greater than a predetermined value and means for preventing the second enrichment means from increasing the amount of fuel to the engine when the detected throttle valve opening position is at a degree greater than the reference value.

2. The fuel supply control system as claimed in claim 1, wherein the first enrichment means increases the amount of fuel to the engine when the detected throttle valve opening degree changes at a rate greater than a predetermined value.

3. The fuel supply control system as claimed in claim 1, wherein the reference value is dependent on the sensed engine speed.

4. The fuel supply control system as claimed in claim 1, wherein the reference value is constant.

5. The fuel supply control system including means for supplying a controlled amount of fuel to an internal combustion engine having a throttle valve movable for controlling air flow to the engine, comprising:

sensor means for detecting engine operating conditions including engine load and engine speed;

a throttle sensor for detecting the degree of opening of the throttle valve; and a control unit for controlling the amount of fuel to the engine in accordance with the detected engine operating conditions, the control unit including first enrichment means responsive to a demand for engine acceleration for increasing the amount of fuel to the engine, and means for preventing the first enrichment means from increasing the amount of fuel to the engine when the detected throttle valve opening position is at a degree greater than a reference value dependent on the sensed engine speed.

6. The fuel supply control system as claimed in claim 5, wherein the first enrichment means increases the amount of fuel to the engine when the detected throttle valve opening degree changes at a rate greater than a predetermined value.

7. The fuel supply control system as claimed in claim 5, wherein the control unit includes second enrichment means for increasing the amount of fuel to the engine when the detected engine load is greater than a predetermined value and means for preventing the second enrichment means from increasing the amount of fuel to the engine when the detected throttle valve opening position is at a degree greater than the reference value.

* * * * *